US005318791A

United States Patent [19]

Millman et al.

[11] Patent Number: 5,318,791

[45] Date of Patent: Jun. 7, 1994

[54] APPARATUS AND METHOD FOR COLD WATER INFUSION OF BEVERAGE AND SWEETENER

[76] Inventors: Paul Millman, 201 W. 70th St., New York, N.Y. 10023; Mark Schwartz, 4089 Aberdeen Ct., Orchard Lake, Mich. 48323

[21] Appl. No.: 1,565

[22] Filed: Jan. 6, 1993

[51] Int. Cl.[5] ..... A47J 31/00

[52] U.S. Cl. ..... 426/431; 426/435; 99/279; 99/299; 99/323

[58] Field of Search ..... 99/279, 299, 323; 426/431, 435

[56] References Cited

U.S. PATENT DOCUMENTS

| | | | |
|---|---|---|---|
| 3,517,604 | 6/1970 | Coors | 99/323 |
| 3,861,284 | 1/1975 | Costello | 99/323 |
| 4,602,557 | 7/1986 | Yip | 99/279 |
| 4,864,921 | 9/1989 | Ross | 99/279 |
| 5,129,524 | 7/1992 | Holman | 99/323 |

*Primary Examiner*—Caleb Weston
*Attorney, Agent, or Firm*—Natter & Natter

[57] ABSTRACT

A cold water infusion apparatus and method for brewing iced tea and similar beverages includes a vessel, having a removable lid, for containing the water and a tabular guideway supported from the lid and extending into the water. A string having an infusion pouch at one end and a tag at the other end is selectively engaged in the guideway. A lower edge of the guideway retains the pouch in a submerged position within the water. A dispenser attached to the guideway, is fillable with a granulated sweetener, and is simultaneously submergable with the pouch for dissolving the sweetener in the water.

16 Claims, 2 Drawing Sheets

FIG. 1
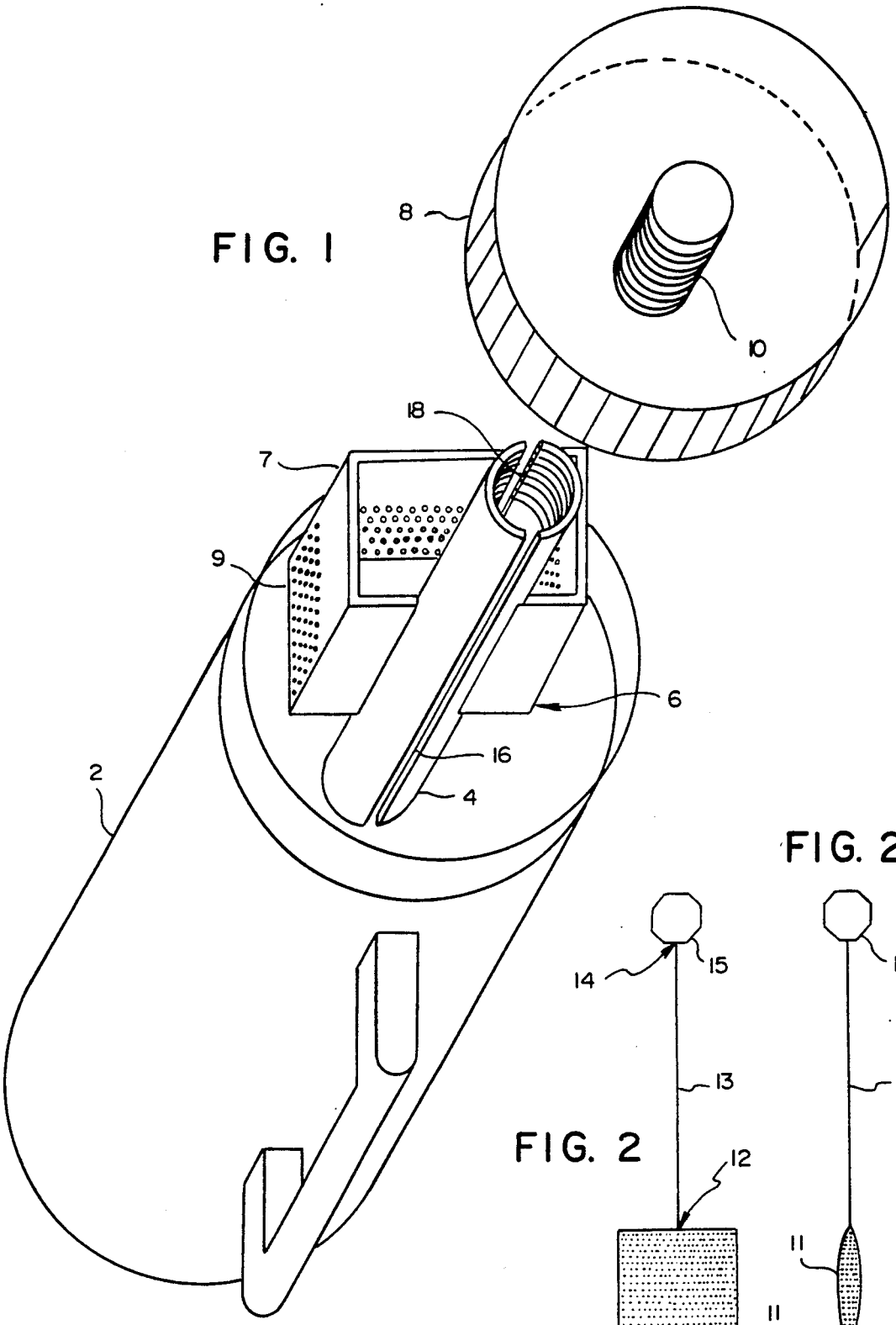
FIG. 2A
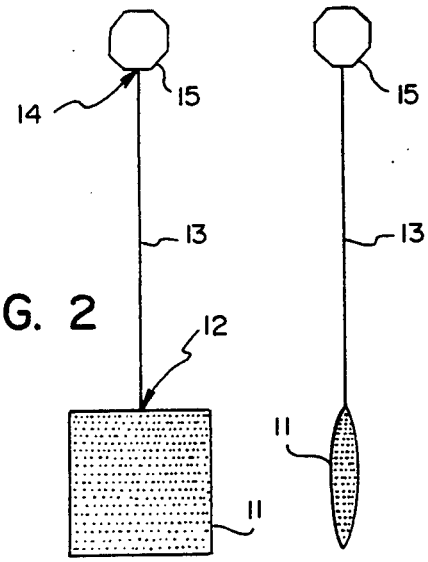
FIG. 2

APPARATUS AND METHOD FOR COLD WATER INFUSION OF BEVERAGE AND SWEETENER

TECHNICAL FIELD

This invention relates generally to an apparatus and method for producing a beverage from an infusible material such as coffee or tea, and for simultaneously sweetening said beverage with soluble granulated sweetener. In particular, the invention concerns a method and device for cold water brewing of infusible beverages such as iced tea, made possible by positive positioning of string suspended porous pouches within surrounding water, coupled with sweetening by gradual introduction of granulated sweetener, via a perforated dispenser.

BACKGROUND ART

Almost two billion gallons of iced tea are consumed annually in the United States. Two brewing methods are commonly used (as described in The New York Times, Jun. 10, 1992).

The "traditional method" requires bringing cold water to rolling boil, and steeping with tea bags for 5-10 minutes. The hot tea is then poured over ice.

The "cool water method" requires placing teabags in a pitcher with cold water, refrigerating, and letting stand five hours.

One herbal tea manufacturer currently publicizes a teabag capable of producing tea in under 2 hours, using the cool water method.

Both methods present disadvantages. In the "traditional method", the entire operation is relatively quick, between 15 and 20 minutes. However, it is laborious, requiring transfer of liquid from faucet to teakettle to pitcher.

Furthermore, it is energy consumptive. Energy is expended to boil the water, and more energy is expended to cool the tea back from boiling, using ice cubes produced by refrigeration. Energy conservation is a significant concern in the United States today. Furthermore, from a strictly economic point of view, the user pays for the fuel and electricity required to successively heat and cool the beverage.

The "cool water method" overcomes these disadvantages, but the procedure takes five hours. This time duration is required primarily because tea bags tend to float to the surface of the water in which they are initially immersed, a configuration not conductive to diffusion.

The present invention, by permitting relatively rapid brewing in cool water, overcomes the disadvantages of each of the foregoing methods. It eliminates the need for successive heating and cooling, and the relatively rapid brewing process is more practical than the "cool water method."

Additionally, the present invention eliminates adulteration of the beverage from contact with the immersed paper tag or staple generally located at the terminus of the suspension string of commercially available tea bags.

Further, the present invention provides for simultaneous, gradual introduction of granulated sweetener, eliminating the stirring which would otherwise be necessary to prevent the undesirable accumulation of granulated sweetener on the bottom of the vessel.

Various devices have been disclosed for use in preparing an infusible beverage, particularly coffee and tea.

The use of a string suspended porous pouch for beverage infusion within a closed container is disclosed in U.S. Pat. Nos. 1,976,091 (Pritchett) and 2,995,998 (Howland). U.S. Pat. No. 1,976,091 (Pritchett) discloses a string suspended porous pouch. U.S. Pat. No. 2,995,998 (Howland) is a straightforward use of the tea bag, in a disposable device suitable for hot water brewing, but not for cold water brewing.

The general concept of making cold water infusions was recognized in U.S. Pat. No. 3,199,437 (Nelson). This reference discloses an infusion apparatus having a water pervious, flexible inner bag filled with ground coffee which is centered within a water impervious outer bag by projections, which prevent the inner bag from floating upward.

Both U.S. Pat. No. 4,443,481 (Donarumma) and U.S. Pat. No. 5,047,252 (Liu, et al.) disclose methods for production of a single cup beverage using devices which provide increased mass transfer and extraction efficiency. Unlike these patents the present invention is suitable for production of several quarts of beverage, is not dependent upon agitation (rotation or dunking) by the user, nor is it dependent upon a custom fabricated porous pouch, but is intended for use with standard commercially available tea bags.

The present invention differs from the foregoing art in that it does not require a customized porous pouch, but rather features a system for positively positioning the commercially available string suspended tea bag. Further, unlike the foregoing art, the present invention permits the simultaneous introduction of granulated sweetener while infusion is proceeding.

SUMMARY OF THE INVENTION

The present invention provides an apparatus and method by which an infusible beverage, particularly tea, may be produced in a short period of time, in cold water, using string suspended disposable porous pouches (tea bags) which are available commercially. Further, the present invention provides an apparatus and method by which dissolved granulated sweetener is gradually introduced to the beverage while the infusion is proceeding.

The device of the present invention includes a suitable vessel such as a jar or pitcher, a guideway, a sweetener dispenser, and a lid for the vessel.

The lid provides the vessel with a water-tight seal. The lid or vessel may contain a pour spout.

The guideway is tubular in the preferred embodiment. When positioned vertically, its height is approximately equal to the length of a tea bag suspension string, its cross section dimensioned to accommodate a plurality of tea bag strings.

The guideway has a vertical slot running its full height. Directly opposite the full height slot is a shorter slot. The height of the short slot is slightly greater than the height of the lid deformation. Within the guideway is a horizontal spar which aids in positioning the strings.

The top of the guideway is deformed in such a manner that it engages a complementary deformation in the lid, so that the guideway may be readily attached to or detached from the lid.

The sweetener dispenser consists of a reservoir equipped with perforations and graduated markings which correspond to specified volumes, to assist the user in measuring. In the preferred embodiment, the dispenser is constructed integrally with the guideway.

In use, the guideway and integral reservoir are initially detached from the lid. The desired number of teabags are threaded through the guideway, by inserting the collection of strings laterally through the full height slot, around the spar, and through the short slot. The desired amount of sweetner is then placed in the dispenser. The guideway and reservoir are then attached to the lid.

The assembled guideway, dispenser and lid are immersed in the vessel filled with cold water. As the teabags attempt to float to the surface of the water, they are restrained by the lower edge of the guideway, and are constrained to remain immersed within the water. The beverage will reach the desired strength in a relatively short period of time, even when placed in a refrigerator. The sweetener dispenser is constructed such that sweetener dissolves in the surrounding water in approximately the same amount of time required for beverage infusion.

when desired beverage strength is achieved, the lid is removed from the vessel, and the guideway and reservoir removed from the lid. The disposable teabags are discarded, and the guideway and reservoir put aside for future use. The lid is replaced on the vessel, where its water-tight seal acts to prevent spillage.

BRIEF DESCRIPTION OF THE DRAWINGS

FIG. 1 is an axonometric view of a beverage infusion device of the present invention shown in exploded fashion;

FIG. 2 is a front elevational view of a string suspended porous pouch, of the type to be used in conjunction with the present invention;

FIG. 2A is a side elevational view of the string suspended porous pouch;

DETAILED DESCRIPTION OF THE INVENTION

Figure 3:
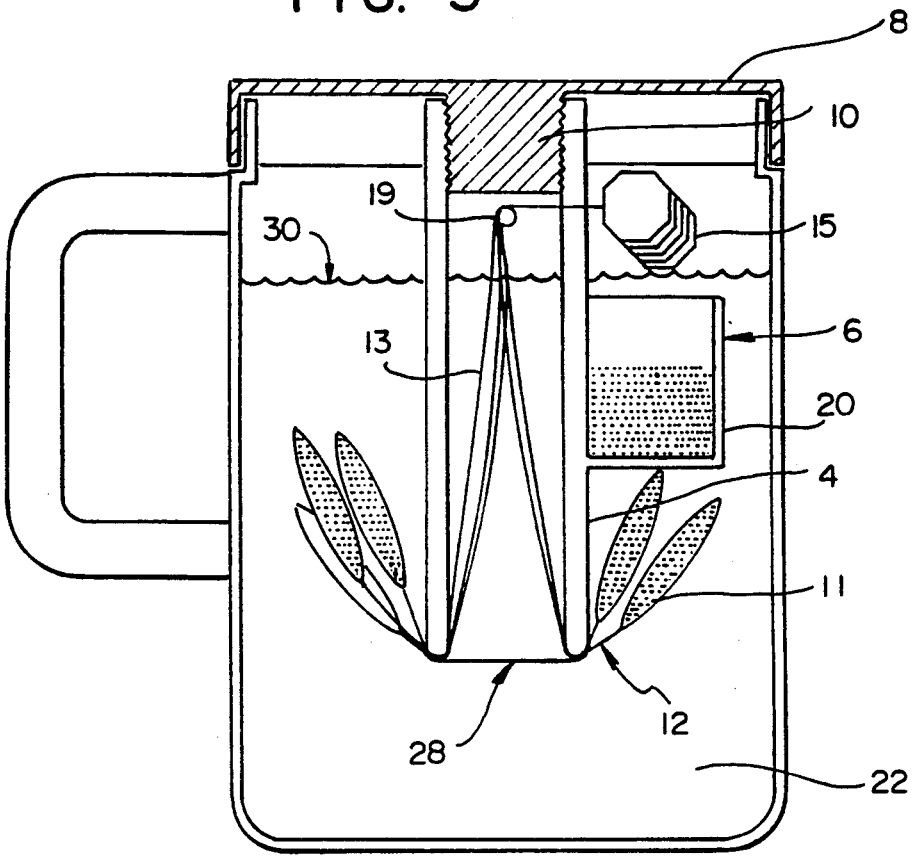
FIG. 3 is a side elevational view in section showing a vessel, a guideway, a dispenser, and a lid as assembled.

The present invention provides an apparatus and method by which an infusible beverage, such as coffee or tea, may be produced rapidly in cold water, and by which granulated sweetener may be simultaneously introduced to the beverage. The invention is compatible with string suspended disposable porous pouches (tea bags) which are available commercially. It should be understood however, that the pouch 11 can contain any substance that is dissolvable in a liquid and thus the apparatus of this invention could be applied for other related uses.

Referring now to the drawings, a typical porous pouch is illustrated in FIG. 2, and consists of a pouch 11 secured to a lower end 12 of a string 13 and a tag 15 attachable to an upper end 14.

FIG. 1 illustrates a beverage infusion device of the present invention having a suitable vessel 2 such as a jar or pitcher, a guideway 4, a dispenser 6, and a lid 8. To enhance clarity of the drawing, neither porous pouches nor water nor sweetener are illustrated in FIG. 1.

For the purposes of the present invention, the vessel 2 is formed with a mouth 3 and has a capacity between 1 pint and 2 gallons, and is made of glass or plastic.

The detachable lid 8 of the present device is made of plastic or metal, and is so structured that a watertight seal may be formed with the mouth 3 of the vessel 2, by use of a snug friction fit or mechanical interlock such as a threadable connection.

The underside of the lid 8 is equipped with a protrusion forming a post 10. The cross-sectional shape of the post 10 matches the cross-section of the guideway 4 described below, such that the post 10 nests within the upper portion of the guideway 4. The post 10 is so structured that it provides a threadable connection between the lid 8 and the guideway 4 of the present device, as by a snug friction fit, mechanical interlock or threadable connection.

Figure 4:
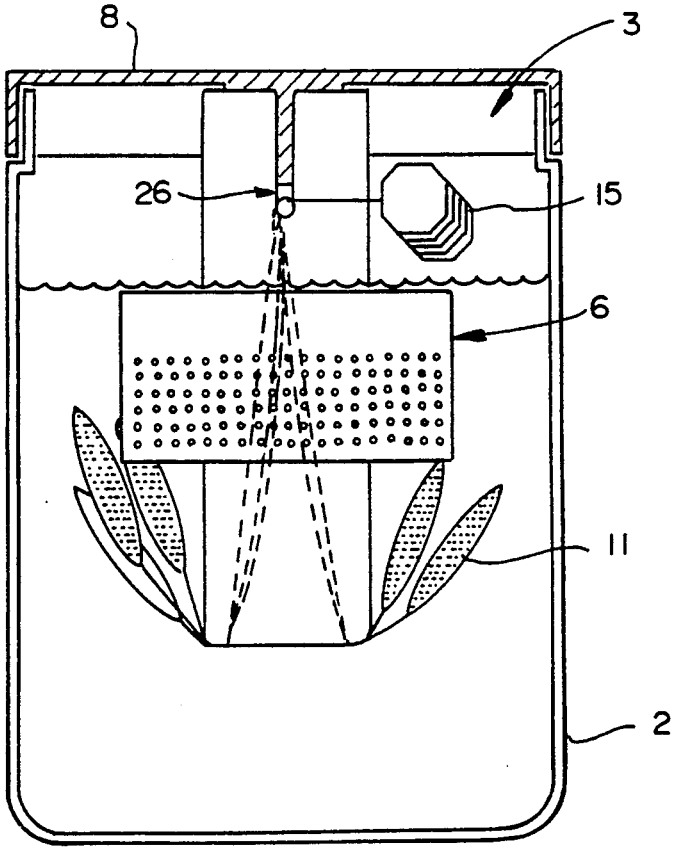
FIG. 4 is a side elevational view partially in section and rotated 90 degrees with respect to FIG. 3.

Alternatively, the post 10 may be hollow and configured such that the top of the guideway 4 nests within the post 10. The guideway 4 may thus be readily attached to or detached from the lid 8. FIGS. 3 and 4 illustrate the relationship between the guideway 4 and the lid 8 when attached.

The guideway 4 is made of plastic or metal, and may be of any suitable cross-sectional configuration, the preferred embodiment of the guideway 4 being tubular or cylindrical in shape. When positioned vertically, the height of the guideway 4 is approximately equal to the length of the suspension string 13 of a commercially available tea bag. The cross-section of the guideway 4 is dimensioned to accommodate a plurality of tea bag strings 13.

The guideway 4 has a vertical slot 16 extending the full height of the guideway 4. Directly opposite the full height slot 16 is a shorter slot 18 which extends from an upper edge 30 of the guideway 4. The height of the short slot 18 is slightly greater than the height of the post 10. Running horizontally across the guideway 4 and perpendicularly to an imaginary line drawn between the two slots 16 and 18 and at a position slightly below the bottom of the short slot 18, is a spar 19 which aids in positioning the suspension strings 13 running through the guideway 4. The short slot 18 may be located elsewhere, e.g. adjacent to the full height slot 16.

The sweetner dispenser 6 consists of a reservoir 7 equipped with a plurality of perforations 9. The reservoir 7 is a thin walled receptacle open on the top. The interior of the reservoir 7 has markings (not illustrated) calibrated to correspond to specified volumes to assist the user in measuring the desired amount of a granulated sweetner 20. When the sweetener dispenser 6 is submerged within a liquid 22, the sweetener 20 within the dispenser 6 migrates through the perforations 9 to the region outside the reservoir 7 where the sweetener 20 concentration is lower and the sweetener 20 dissolves in the surrounding liquid 22. The perforations 9 are shaped and dimensioned such that the reservoir 7 will completely empty itself of the sweetener 20 in the same amount of time required for beverage infusion.

The gradual introduction of the sweetener 20 into liquid solution eliminates the objectionable accumulation of undissolved sweetener 20 on the bottom of the vessel 2, which might otherwise occur when one attempts to dissolve a granulated sweetener within cold water.

In the embodiment illustrated the dispenser 6 is rectangular in shape, open at the top. It is located adjacent to and constructed integrally with the guideway 4 and made of the same material as the guideway.

FIG. 3 illustrates a side view of one embodiment of the beverage infusion device of the present invention including the string suspended porous pouches 11, the granulated sweetener 20, and the quantity of liquid 22 such as water.

In operation, the guideway 4 and the dispenser 6 are initially detached from the lid 8. The user threads the desired number of teabag suspension strings 13 through the guideway 4, by inserting the collection of strings laterally through the full height slot 16, over the spar 19, and through the short slot 18 on the guideway 4. Once threaded through the full height slot 16, the suspension strings 13 are constrained to remain within the interior of the guideway 4, until they are manually removed by the user.

In an alternative embodiment, not illustrated, the guideway telescopes, via nested tubular segments, so that its overall height may be adjusted to accommodate tea bag strings of varying lengths.

The user next places the desired amount of the granulated sweetener 20 within the dispenser 6.

Finally, the user attaches the guideway 4 and the reservoir 7 to the lid 8, by inserting the lid post 10 within the guideway 4, and manipulating the lid 8, as required, to activate the mechanical interlock beneath the lid 8 and the guideway 4.

When the lid 8 and the guideway 4 are attached, the teabag suspension strings 13 are held securely in place. In the embodiment illustrated in FIG. 4, the tag 15 at the upper end of the tea bag string 13 is substantially larger than a small aperture 26 formed by that portion of the short slot 18 below the lowest point of the post 10 and the tag 15 is thereby constrained to remain outside the guideway 4. The post 10 can also clamp the string 13 against the spar 19. In an alternative embodiment, not illustrated, the suspension string 13 can be clamped between the surface of the post 10 and the inside wall of the guideway 4.

The user then lowers the guideway 4, the reservoir 7, and the lid 8 into the vessel 2 filled with the cold liquid 22 in this instance-water. As illustrated in FIG. 4, a preferred water level 30 is slightly below the level of the bottom of the short slot 18 on the guideway 4. Through this arrangement, the infusion takes place without adulterating the beverage through contact with the paper tag 15 or metal staple, usually found at the upper terminus of the tea bag string 13.

As the porous pouches 11 attempt to float to the surface of the water 22, their suspension strings 13 are restrained by the lower edge 28 of the guideway 4. The porous pouches 11 are thus constrained to remain fully immersed within the water 22. Because the porous pouches 11 are fully immersed, they are in more complete contact with the water 22, and beverage infusion occurs significantly faster, than if they were floating on the surface.

Concurrently with the beverage infusion, the submerged sweetener 20 within the dispenser 6 migrates through the perforations 9 to the region outside the reservoir 7, and dissolves completely, in approximately the same amount of time required for beverage infusion.

Trial runs have produced typical infusion times of fifteen (15) minutes, even with the vessel placed in a refrigerator immediately after immersion of the teabags.

When the desired strength is achieved, the lid is removed from the vessel 2, and the guideway 4 and the reservoir 7 separated from the lid 8, by reversing the process by which they were attached. The disposable porous pouches 11 are discarded, and the guideway 4 and the reservoir 7 rinsed and saved for future use. The lid 8 is replaced on the vessel 2, where it serves to prevent spillage.

The lid 8 may also contain an integral pour spout or the vessel 2 may contain an integral pour spout.

It should thus be seen that there is provided a cold water beverage infusion device which achieves the various objects of this invention and which is well adapted to meet conditions of practical use.

Since various possible embodiments might be made of the present invention or modifications might be made to exemplary embodiments above set forth, it is to be understood that all materials shown and described above are to be interpreted as illustrative, and not in a limiting sense.

Having thus described the invention, there is claimed as new and desired to be secured by Letters Patent:

1. A beverage infuser adapted for use with a string suspendable pouch containing a liquid-infusible substance comprising a vessel for receiving a liquid, said vessel defining a mouth, lid means for providing a selective closure over the mouth of the vessel, said lid means further defining a post depending from the lid and being extendable into the vessel, a guideway adapted for cooperative engagement with the post, said guideway including string receiving means for securing the pouch in a liquid submerged position whereby the pouch is constrained against the buoyant force of the liquid for dissolving the pouch contents within the liquid.

2. A beverage infuser as claimed in claim 1 wherein the string receiving means includes a first slot within the guideway.

3. A beverage infuser as claimed in claim 2 wherein the guideway defines a lower edge, said lower edge being adapted for retaining a lower end of the string with said attached pouch being positionable beyond the lower edge of the guideway.

4. A beverage infuser as claimed in claim 3 wherein the guideway includes an upper edge, a second slot extending from the upper edge of the guideway, said second slot being adapted for securing an upper end of the string.

5. A beverage infuser as claimed in claim 4 wherein the guideway includes an interior portion with the first slot providing access to the interior portion of the guideway for accommodating the string within the guideway.

6. A beverage infuser as claimed in claim 5 wherein the post is interlockingly engageable with the guideway and selectively adjustable with respect to the upper edge of the guideway for varying the length of the second slot.

7. A beverage infuser as claimed in claim 5 further including a spar, said spar extending within the interior of the guideway, said string being adapted for placement over the spar with an upper end of the string being secured through the second slot.

8. A beverage infuser as claimed in claim 7 wherein the string is clampingly engaged between the post and the spar.

9. A beverage infuser as claimed in claim 7 wherein the first slot extends longitudinally along the length of the guideway.

10. A beverage infuser as claimed in claim 9 wherein the length of the guideway corresponds to the length of the string.

11. A beverage infuser as claimed in claim 1 further including a sweetener dispenser, said sweetener dispenser being attachable to the guideway.

12. A beverage infuser as claimed in claim 11 wherein the sweetener dispenser includes a receptacle containing a plurality of perforations.

13. A method for cold water infusion of a beverage within a vessel using an infusible substance contained within a porous pouch suspended from one end of a string and a tag attached to the other end of the string comprising the steps of:

(a) pouring cold water into the vessel, (b) engaging the string suspended porous pouch with an elongated guideway, (c) securing an upper edge of the guideway to the lid, (d) positioning the lid over the vessel whereby the guideway submergingly retains the pouch within the water.

14. A method for cold water infusion of a beverage as claimed in claim 13 further including the step of:

(e) adding granulated sweetener to a dispenser and simultaneously submerging the dispenser and the pouch within the water.

15. A method for cold water infusion of a beverage as claimed in claim 14 wherein the granulated sweetener is placed within the dispenser in calibrated graduations.

16. A method for cold water infusion of a beverage as claimed in claim 13 wherein the string is engaged with the elongate guideway by placing an upper end of the string and attached tag within a slot extending from the upper edge of the guideway, and including the further step of:

(f) maintaining the water within the vessel at a level below the slot such that the tag remains above the water level.

* * * * *